US005868262A

United States Patent [19]

Carson

[11] Patent Number: 5,868,262

[45] Date of Patent: Feb. 9, 1999

[54] GLIDE RACK INSERT WITH INTEGRAL TEXTURED SURFACE

[75] Inventor: Steven P. Carson, Loganville, Ga.

[73] Assignee: Rehrig-Pacific Company, Inc., Los Angeles, Calif.

[21] Appl. No.: 826,051

[22] Filed: Mar. 28, 1997

Related U.S. Application Data

[63] Continuation of Ser. No. 720,801, Oct. 1, 1996, abandoned.

[51] Int. Cl.[6] ..... A47F 5/00

[52] U.S. Cl. ..... 211/59.2; 211/183; 211/74

[58] Field of Search ..... 211/59.2, 183, 211/74, 59.3; 312/42, 45, 60

[56] References Cited

U.S. PATENT DOCUMENTS

| | | | |
|---|---|---|---|
| 4,314,648 | 2/1982 | Spamer | 211/59.2 |
| 4,565,725 | 1/1986 | Spamer et al. | 211/59.2 X |
| 4,785,945 | 11/1988 | Rowse et al. | 211/59.2 |
| 4,809,855 | 3/1989 | Bustos | 211/59.2 |
| 4,947,999 | 8/1990 | Warp | 211/183 |
| 4,960,210 | 10/1990 | Spamer | 211/59.2 |
| 5,022,535 | 6/1991 | Spamer | 211/59.2 |
| 5,050,748 | 9/1991 | Taub | 211/59.2 |
| 5,160,051 | 11/1992 | Bustos | 211/59.2 |
| 5,197,610 | 3/1993 | Bustos | 211/59.2 |
| 5,205,421 | 4/1993 | Bustos | 211/59.2 |
| 5,614,288 | 3/1997 | Bustos | 211/59.2 X |
| 5,695,076 | 12/1997 | Jay | 211/59.2 |
| 5,695,077 | 12/1997 | Jay | 211/59.2 |

OTHER PUBLICATIONS

Retro–Track™ advertisement of Display Technologies, *Beverage World,* Oct., 1996, p. 27.

Claims of U.S.S.N. 08/720,800 of Danny Lecroy.

*Primary Examiner*—Robert W. Gibson, Jr.

*Attorney, Agent, or Firm*—Banner & Witcoff, Ltd.

[57] ABSTRACT

The present invention provides an insert for a glide rack, with the insert being dimensioned to correspond to the given length and width of a row of the glide rack. The insert is fitted within the row of the glide rack such that the glide characteristics of the row of the glide rack are improved and the containers slide more easily toward the forward end thereof. The insert is preferably manufactured from a high density polyethylene.

10 Claims, 2 Drawing Sheets

GLIDE RACK INSERT WITH INTEGRAL TEXTURED SURFACE

This application is a continuation of application Ser. No. 08/720,801, filed Oct. 1, 1996 now abandoned.

TECHNICAL FIELD

The present invention relates to an improvement for glide racks or display racks used in refrigerated beverage display cases, and in particular, an insert positionable in each glide rack row to thereby prolong the useful life of the glide rack.

BACKGROUND OF THE INVENTION

Refrigerated display cases for beverage containers, and the like, generally include vertically aligned rows of racks, commonly called glide racks, upon which the beverage containers are loaded. The beverage containers may be cans or bottles of any size and the width of the glide rack rows are adjusted accordingly to accommodate each particular container. Glide racks may also be used for gallon jugs of a beverage, such as milk, or for any other type of container that may displayed for sale within a refrigerated case. Referring to FIG. 1, a typical prior art glide rack is shown generally be reference number 10. The glide rack includes a plurality of rows 12 extending from the front 14 of the glide rack to the rear 16 thereof. Each row may then be loaded with rows of beverage containers 18 extending from the front of the display case to the rear of the display case. Each glide rack is disposed within the refrigerated display case at an angle of approximately five to twelve degrees. Thus, when the forwardmost beverage container 18' is removed from the row 12 by a consumer, the next beverage container 18" will move forward to occupy the forwardmost position, and the remainder of the row of beverage containers will follow. In this manner, there is always a beverage container at the front of each row of the glide rack ready to be dispensed to a consumer.

As shown in FIG. 1, the support surface 20 of each row 12 of the glide rack includes a plurality of slots extending therethrough. These slots allow any spillage that may occur from the beverage containers to drain to the bottom of the display case. The slots also reduce the surface area of the support surface 20 so that there is less contact with the beverage containers and they therefore slide more easily. Prior art glide racks are currently manufactured using a high density polyethylene with a silicone plasticizer. When the racks are poured the resultant plastic material has a directional grain and the silicone is disposed on the exposed surfaces of the glide rack, including the support surface 20, in order to assist the beverage containers in gliding. However, the silicone easily wears off the bottom surface as the beverage containers slide therealong thus decreasing the glidability of the beverage containers.

As the silicone on the sliding surface of the glide rack wears off, more friction is created by the sliding of the beverage containers thereon and the plastic sliding surface of the glide rack becomes more roughened. This in turn creates more problems as the beverage containers may fall over, tip, rotate, occasionally open and spill. The repeated sliding along the roughened sliding surface and the beverage containers tipping and spilling creates a worn and unusable glide rack within only three to four months of use. In the past, it has been necessary to completely replace the entire glide rack once it reached this point of wear and tear, resulting in costly and repeated expenditures.

Accordingly, there is a strong need for a glide rack improvement enabling prior art glide racks to be used for an extended period of time after the initial silicone coating has worn away.

U.S. patent application Ser. No. 08/720,800 of Lecroy, filed Oct. 1, 1996, discloses one solution to the foregoing problems, i.e., a plastic insert which is placed in a worn glide rack to improve the glide characteristics of the rack. Lecroy's insert has an upper surface that is roughened after formation, e.g., by sanding with sandpaper. However, sanding, whether done by hand or by machine, adds time and cost to the manufacturing process.

SUMMARY OF THE INVENTION

The present invention overcomes these disadvantages of the prior art by providing an insert for the glide rack with the insert being dimensioned to correspond to the given length and width of a row of the glide rack. The insert is fitted within the row of the glide rack such that the glide characteristics of the row of the glide rack are improved and the containers slide more easily toward the forward end thereof. The insert is preferably manufactured from a high density polyethylene and has at least a textured upper glide surface. The insert further preferably includes a forward end and a rear end, the forward end being rounded to generally correspond to a forward end of the row of the glide rack. The rear end preferably has a central region generally abutting a rear end of the glide rack row and angled corners disposed on each side of the central region, the angled corners exposing the glide rack row therebeneath and facilitating the easy removal of the insert from the glide rack row.

The present invention further provides a method of making an insert for a glide rack, the method including the steps of providing a sheet of plastic material, cutting the insert from the sheet of plastic material, the insert being dimensioned to fit within an individual row of the glide rack and providing a textured surface for an upper glide surface of the insert. The textured surface may be provided by forming a textured pattern on at least one surface of the sheet of plastic material prior to the insert being cut therefrom, such as by imprinting the textured pattern on the sheet of plastic material or extruding the plastic material to form a sheet material having the textured pattern on at least one surface.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

Figure 1:
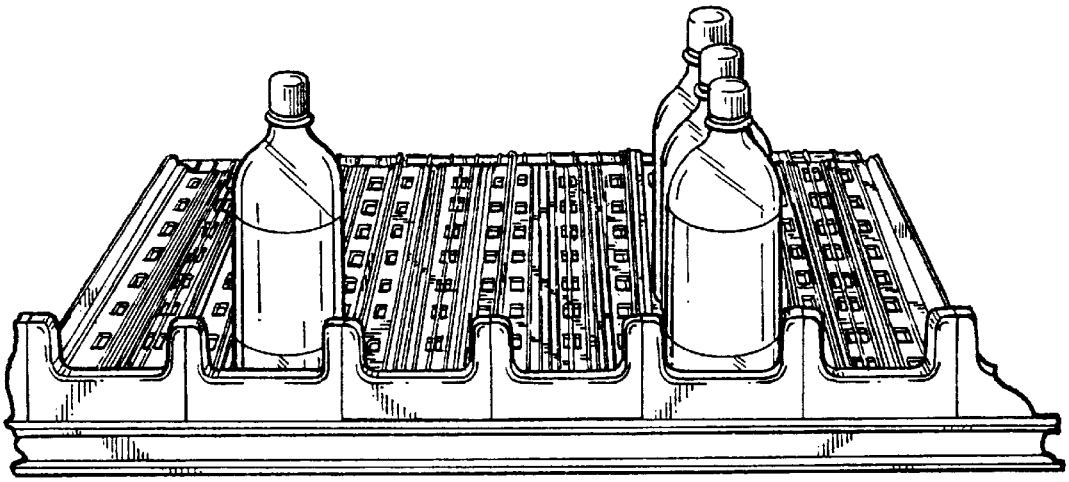
FIG. 1 PRIOR ART
FIG. 1 is a front elevational view of a glide rack according to the prior art.
Figure 2:
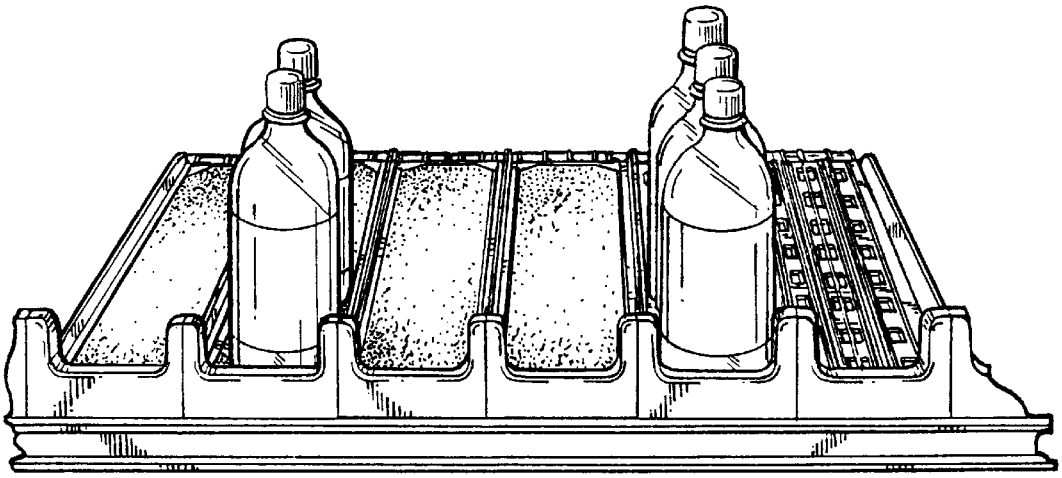
FIG. 2 is a front elevational view thereof including a glide rack insert in accordance with a preferred embodiment of the present invention.

A glide rack insert in accordance with a first preferred embodiment of the present invention is shown generally by reference numeral 30 in FIG. 2. Glide rack insert 30 is dimensioned according to the width and length of the rows 12 of a standard prior art glide rack 10. A glide rack insert 30 is preferably positioned within each row 12 of the glide rack and thereby replaces the worn and torn support surface 20 of the original glide rack. As discussed in detail below, glide rack insert 30 enables the useful life of glide rack to be significantly extended merely by retrofitting an insert 30 into each row. Insert 30 is specifically manufactured to facilitate a smooth gliding motion of the beverage containers as the forwardmost container is removed and when the rows are originally stocked with the chosen beverage.

Figure 3:
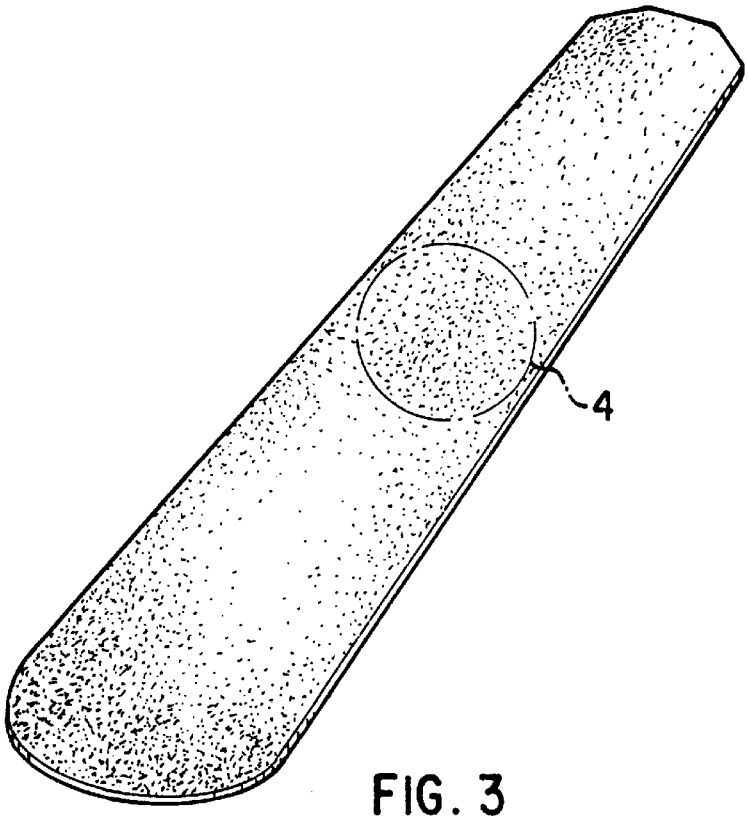
FIG. 3 is a perspective view of the glide rack insert shown in FIG. 2.

Referring also to FIG. 3, glide rack insert 30 has a preferred length "l" of approximately 23.125 inches and a width "w" between approximately 2.5–3.5 inches, depending upon the width of the glide rack. In addition, lengths up to 36 inches or 48 inches may also be made if the length of the subject glide rack so demands. The preferred thickness "t" of insert 30 is approximately 60–65 mil, preferably 65 mil. The glide rack 10 includes raised runners 22 extending the length thereof that define the individual rows 12. Thus, glide rack insert 30 quickly and easily may be inserted between adjacent runners 22 and securely held therebetween. The forward end 32 is preferably rounded with a radius of curvature "r" being approximately 1.25 inches. The rounded forward end 32 generally conforms to the configuration of the front 12 of glide rack 10 and further assures a secure fit of insert 30 within each row 12. The rear end 34 of insert 30 generally corresponds to a truncated triangle, with the central section 36 having a length "cs" of approximately 1.25–1.75 inches, respectively, depending on the overall width "w" of the glide rack insert. The truncated side portions 38 of the rear end define the hypotenuse of an equilateral triangle having legs "tl" of approximately 0.625–0.875 inches, respectively, again depending of the overall width "w" of the glide rack insert. The truncated side portions 38 provide access to the rear end 34 of the insert 30 when it is desired to remove insert 30 from the glide rack. That is, insert 30 fits securely between adjacent runners and must be manually lifted out of the row 12. The truncated side portions 38 provide enough room for a person to place a finger or screwdriver under the insert 30 and thereby remove it from the row.

Glide rack insert 30 is preferably cut by a die mold from a roll or sheet of an extruded sheet of high density polyethylene (HDPE). HDPE has the advantages of being lightweight, having a low moisture absorption, high tensile strength, excellent impact resistance, and it is non-toxic and non-staining. The glide characteristics of the HDPE are an improvement over conventional glide rack plastics since the extruded sheet of HDPE does not contain a directional grain as found in conventional injection molded or poured glide racks. The preferred HDPE is available from Primex located in Richmond, Ind., and has the following physical properties: melt index of 0.3–0.8 g/10 min; density of 0.955 g/cm$^3$; tensile strength at yield of 4600 psi; tensile elongation at yield of 900%; IZOD Impact Notches at 73° F. of 3 ft-lb/in; hardness of 69 Shore D; heat deflection temperature at 264 psi of 110–130; and water absorption of a ⅛" thick specimen at twenty-four hours of 0%. The preferred HDPE is a highly abradable plastic and thus the beverage containers sliding along the insert 30 quickly form a natural path or groove in the insert and thereby further increase the glide performance of the insert. Other high density polyethylenes and other plastic materials could of course be used with varying degrees acceptability. The preferred HDPE has been found to provide the most cost efficient glide rack insert having the most satisfactory glide performance characteristics.

Figure 4:
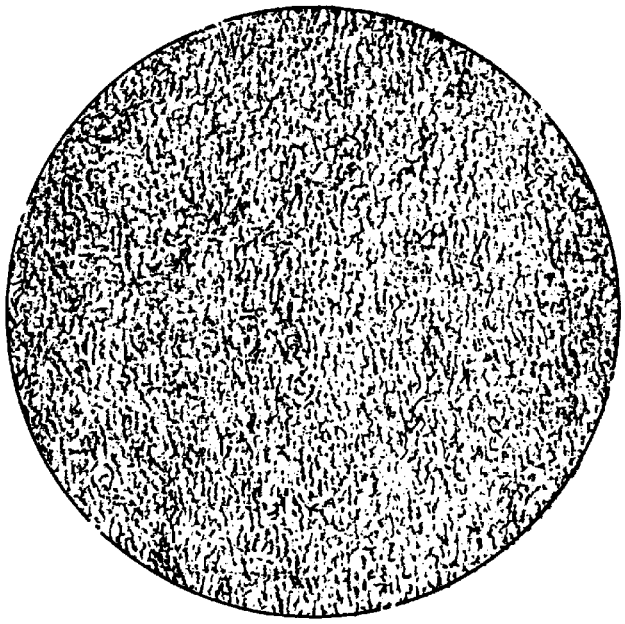
FIG. 4 is an enlarged view of a portion of the glide rack shown by circle 4 in FIG. 3.

Referring also to FIG. 4, glide rack insert 30 includes a roughened upper surface 40 upon which the beverage containers are disposed. The roughened upper surface may be formed by using a textured pattern or by sanding, as described in further detail below. The preferred textured pattern is referred to as "haircell" in the industry, but is only one of a large number of possible textures that may be imprinted on the extruded sheet or roll stock of plastic material. The haircell pattern itself may be enlarged, reduced, disposed transversely across the insert or disposed longitudinally thereon. Although the haircell pattern of texture has generally been used before within the plastics industry for aesthetic purposes on the finished product, as have many other textured patterns, the present invention utilizes the roughened texture surface to reduce the friction between the beverage containers and the glide rack insert and thereby increase the glide characteristics of insert 30. The textured pattern may be applied to the high density polyethylene during the extruding process such that rolls of textured material are produced. Alternatively, the texture pattern may be imprinted onto sheets of the high density polyethylene prior to inserts 30 being cut therefrom.

The present invention can thus refurbish a worn glide rack after the initial silicone coating has worn away from the bottom surface 20 and the desired gliding motion of the beverages containers has decreased. A glide rack insert 30 is selected with the correct width corresponding to each row of the worn glide rack. Insert 30 is secured within the row between adjacent runners and the beverage containers are then loaded into the row on top of insert 30. The sliding of the beverage containers along the row forms a natural groove or abraded path within the textured upper surface 40 of the insert. Thus, the more insert 30 is used, the better the gliding that is achieved. That is, as more and more beverage containers slide down the glide rack row and dust and grit become present on the insert during use, the more defined the natural abraded path is going to become. Therefore, the more defined the path becomes, the more the glide characteristics of the insert 30 will increase.

From the foregoing detailed description, it will be evident that there are a number of changes, adaptations and modifications of the present invention which come within the province of those persons having ordinary skill in the art to which the aforementioned invention pertains. For example, the present glide racks can be adapted to handle bottles, cans, jugs or other types of articles of different sizes, widths, numbers or materials other than those set forth herein. However, it is intended that all such variations not departing from the spirit of the invention be considered as within the scope thereof as limited solely by the appended claims.

I claim:

1. In a glide rack for maintaining a plurality of containers in a proper orientation for dispensing to a user, the glide rack including a plurality of rows in which the containers are aligned and glide toward a forward end of the row when a forwardmost container is removed from therefrom, each of the rows having a given length and width, the improvement comprising:

an insert for the glide rack, said insert being dimensioned to correspond to the given length and width of a row of the glide rack;

and fitted within the row of the glide rack such that the glide characteristics of the row of the glide rack are improved and the containers slide more easily toward the forward end thereof wherein an upper glide surface of said insert has an integral textured pattern.

2. The improvement of claim 1 wherein said insert is manufactured from a high density polyethylene.

3. An insert for a container glide rack having at least one elongated row in which containers are aligned and disposed such that the containers glide forward when a forwardmost one of the containers is removed therefrom, said insert comprising:

a body member having a length and width generally corresponding to the length and width of the elongated row, said body member adapted to be securely disposed within the elongated row;

wherein an upper surface of said body member on which containers are disposed includes an integral textured pattern thereon.

4. The insert of claim 3 wherein said body member includes a forward end and a rear end, said forward end being rounded to generally correspond to a forward end of the elongated row.

5. The insert of claim 4 wherein said rear end of said body member includes a central region adapted generally to abut a rear end of the elongated row, and angled corners disposed on each side of said central region, said angled corners exposing the elongated row of the glide rack therebeneath.

6. The insert of claim 3 wherein said body member comprises a high density polyethylene.

7. A method of making an insert for a glide rack, said method comprising the steps of:

providing a sheet of plastic material;

cutting the insert from the sheet of plastic material, wherein the insert is dimensioned to fit within an individual row of the glide rack; and providing an integral textured pattern to an upper glide surface of the insert.

8. The method of claim 7 wherein said step of providing a textured surface includes forming a textured pattern on at least one surface of the sheet of plastic material prior to the insert being cut therefrom.

9. The method of claim 8 wherein said forming a textured pattern step comprises imprinting the textured pattern on the sheet of plastic material.

10. The method of claim 8 wherein said forming a textured pattern step comprises extruding the plastic material to form a sheet material having the textured pattern on at least one surface.

* * * * *

UNITED STATES PATENT AND TRADEMARK OFFICE

CERTIFICATE OF CORRECTION

PATENT NO : 5,868,262

DATED : February 9, 1999

INVENTOR(S) : STEVEN P. CARSON

It is certified that error appears in the above-identified patent and that said Letters Patent is hereby corrected as shown below:

Column 4, Claim 1, line 59, delete ";"; and

Column 5, Claim 5, line 18, delete "adapted generally to" and insert therefor --adapted to generally--.

Signed and Sealed this

Second Day of November, 1999

*Attest:*

Q. TODD DICKINSON

*Attesting Officer*

*Acting Commissioner of Patents and Trademarks*